US005853093A

United States Patent [19]

Neiger

[11] Patent Number: 5,853,093

[45] Date of Patent: Dec. 29, 1998

[54] RECLOSABLE, TWO-PART CAP ASSEMBLY FOR SODA BOTTLES

[76] Inventor: Eliezer Neiger, 1235 59th St., Brooklyn, N.Y. 11219

[21] Appl. No.: 861,981

[22] Filed: May 22, 1997

[51] Int. Cl.[6] ..... B65D 51/04

[52] U.S. Cl. ..... 215/237; 215/44; 215/45; 215/250; 215/320; 215/321; 215/245; 215/901; 220/324; 220/339; 220/DIG. 34

[58] Field of Search ..... 215/40, 43, 44, 215/45, 250, 237, 235, 320, 321, 343, 344, 345, 383, 901, 245, 274, 276; 220/256, 259, 255, 288, 296, 315, 324, 326, 334, 339, 375, DIG. 19, DIG. 34, 789, 780, 794; 222/556, 542, 541.5

[56] References Cited

U.S. PATENT DOCUMENTS

| | | | |
|---|---|---|---|
| 839,977 | 1/1907 | Zimmerman . | |
| 3,209,963 | 10/1965 | Krieps et al. | 222/542 |
| 3,612,322 | 10/1971 | Linkletter . | |
| 3,938,691 | 2/1976 | Dumas | 220/780 |
| 4,022,352 | 5/1977 | Pehr . | |
| 4,170,315 | 10/1979 | Dubach et al. | 220/339 X |
| 4,358,032 | 11/1982 | Libit | 222/556 X |
| 4,779,756 | 10/1988 | Buelens et al. | 220/337 X |
| 4,846,360 | 7/1989 | Criste . | |
| 4,948,001 | 8/1990 | Magly | 220/296 X |
| 5,083,671 | 1/1992 | Hayes | 215/245 |
| 5,417,339 | 5/1995 | Liu | 220/315 |
| 5,582,333 | 12/1996 | Bennett | 222/556 X |

*Primary Examiner*—Allan N. Shoap
*Assistant Examiner*—Robin A. Hylton
*Attorney, Agent, or Firm*—Goldstein & Canino

[57] ABSTRACT

A bottle cap assembly, comprising a main portion, and a lid. The main portion and lid are attached by a hinge. The main portion is selectively secured to the lid with a latch, the latch opposite the hinge. The main portion has a central bore, and the hinge has a plug which fits in the central bore when the cap is closed. The central bore has internal grooves, and the plug has protuberances which match the internal grooves to effect a tight seal between the central bore and plug. The main portion further has an upper groove, and the lid has a ring which fits in the upper groove. The ring is larger in diameter and concentric with the plug. At least one opening preventer attaches between the lid and main portion to prevent inadvertant opening of the bottle and for revealing tampering to the bottle, since the opening preventer can be opened once, and then cannot be restored.

7 Claims, 4 Drawing Sheets

RECLOSABLE, TWO-PART CAP ASSEMBLY FOR SODA BOTTLES

BACKGROUND OF THE INVENTION

The invention relates to an cap assembly for soda containers. More particularly, the invention relates to a bottle cap which attaches onto a standard soda container, and allows the container to be easily opened, and then securely closed when desired.

Soda is a beverage which comprises carbon dioxide gas dissolved in flavored water. The carbon dioxide gas is dissolved in the water by pressurizing the gas, and thus forcing it into solution. Once the soda is in an environment at normal atmospheric pressure, the carbon dioxide forms bubbles which slowly escape from the liquid, leaving the soda "flat". Thus, storage of soda requires isolating the soda from normal atmospheric pressure.

Soda is commonly sold in 2-liter bottles which have screw-top caps that must be screwed on and off each time the bottle is opened and closed. The screw-top cap provides sufficient strength and a sufficient seal to maintain pressurization within the bottle.

Although the standard screw-top cap works well in sealing the bottle, it falls short by failing to provide easy access to the contents. That is, the cap must be screwed and unscrewed each time it is desired to open or close the bottle.

U.S. Pat. No. 3,612,322 to Linkletter; 839,977 to Zimmerman and 4,022,352 to Pehr each disclose container closure devices. These devices are not suited for topping a soda container, because they cannot adequately maintain pressurization within a bottle.

U.S. Pat. No. 4,846,360 to Criste discloses a reusable bottle cap which has a wide flange portion. The cap screws onto the bottle, and then allows the bottle to be stored in an inverted position, so that the liquid contents of the bottle provide a barrier against escaping gases. Although this device might provide effective long term storage of soda, it fails to provide convenient access to the soda.

While these units may be suitable for the particular purpose employed, or for general use, they would not be as suitable for the purposes of the present invention as disclosed hereafter.

SUMMARY OF THE INVENTION

It is an object of the invention to produce a bottle cap which attaches onto a conventional soda bottle, either as a replacement cap provided by the consumer or as an original cap provided by the manufacturer subsequent to filling the bottle.

It is another object of the invention that once installed, the bottle cap allows easy access to the contents of the bottle, without necessitating that the user screw and unscrew the cap each time.

It is a further object of the invention that the bottle cap is configured to provide an effective seal to prevent gases from escaping, or liquids from leaking.

It is a still further object of the invention that the bottle cap has provisions for preventing inadvertent opening of the cap during shipping, and for revealing the presence of tampering to the end consumer.

The invention is a bottle cap assembly, comprising a main portion, and a lid. The main portion and lid are attached by a hinge. The main portion is selectively secured to the lid with a latch, the latch opposite the hinge. The main portion has a central bore, and the hinge has a plug which fits in the central bore when the cap is closed. The central bore has internal grooves, and the plug has protuberances which match the internal grooves to effect a tight seal between the central bore and plug. The main portion further has an upper groove, and the lid has a ring which fits in the upper groove. The ring is larger in diameter and concentric with the plug. At least one opening preventer attaches between the lid and main portion to prevent inadvertant opening of the bottle and for revealing tampering to the bottle, since the opening preventer can be opened once, and then cannot be restored.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
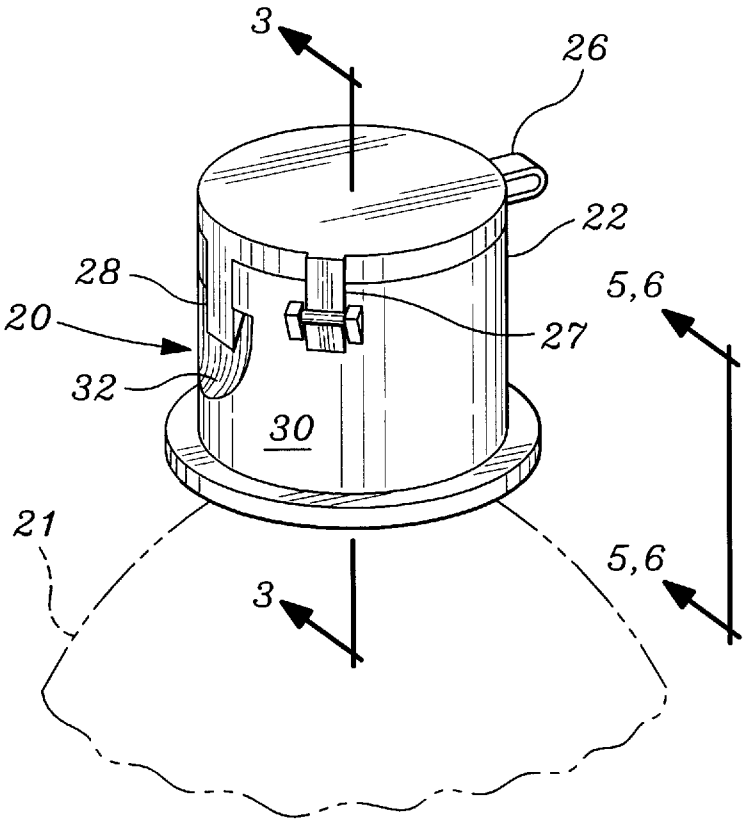
FIG. 1 is a diagrammatic perspective view, illustrating the cap installed on a standard soda bottle.

FIG. 1 illustrates a cap assembly 20, mounted atop a bottle 21. The cap assembly 20 has a main portion 22 and a lid 24. The lid 24 is hingeably attached to the main portion 22 with a hinge 26, and is thus capable of opening and closing. The lid 24 is selectively secured to the main portion 22 with a latch 28. Said latch 28 is preferably located opposite the hinge 26.

The main portion 22 is cylindrical in shape having an outer circumference 30. When the latch 28 is securing the lid 24 to the main portion 22, the latch 28 is flush with the outer circumference 30. A finger recess 32 is provided into the outer circumference 30, adjacent the latch 28, to allow a user to release the latch 28.

At least one opening preventer 27 initially secures the lid 24 to the main portion 22. The opening preventer 27 is configured to prevent the cap assembly from inadvertently opening during shipping, in the retail store, etc. However, the opening preventer 27 is also configured to allow easy opening of the cap assembly by the ultimate consumer. The opening preventer 27 would also reveal if the cap assembly has been tampered with, since once opened, the opening preventer 27 cannot be restored to its original position.

Figure 2:
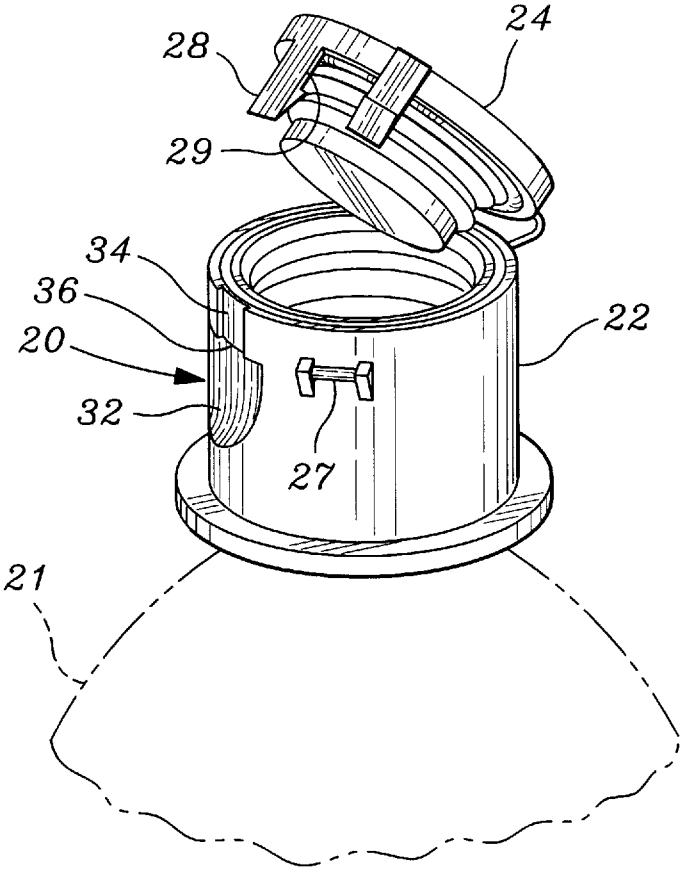
FIG. 2 is a diagrammatic perspective view similar to FIG. 1, except after the cap has been opened by a consumer.

In FIG. 2, the cap assembly 20 has been opened to provide access to contents of the bottle 21. The latch 28 has been released from the main portion 22, revealing a latch recess 34 and a catch 36 between the latch recess 34 and finger recess 32. The latch 28 has a latch hook 29. When securing the lid 24 to the main portion 22, the latch 28 extends in the latch recess 34, and the latch hook 29 holds fast at the catch 36.

Also illustrated in FIG. 2, the opening preventer has been broken to allow the cap assembly 20 to open.

Figure 3:
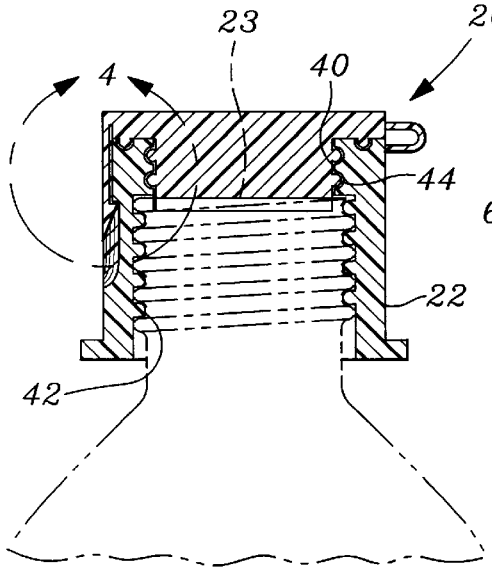
FIG. 3 is a cross sectional view, taken along line 3—3 in FIG. 1.

FIG. 3 is a cross sectional view, which illustrates internal details of the cap assembly 20 in the sealed position. The main portion 22 has a central bore 40, and an attachment device 42. The attachment device 42 illustrated in FIG. 3 is a slightly enlarged, internally threaded area along the central bore 40, which is screwed onto a conventional soda bottle 21, forming a tight seal thereupon. The lid 24 includes a plug 44 which is sized and shaped to fit in the central bore 40. The bottle has a top 23, said plug extending into the bottle 21 slightly beyond said top 23.

Figure 4:
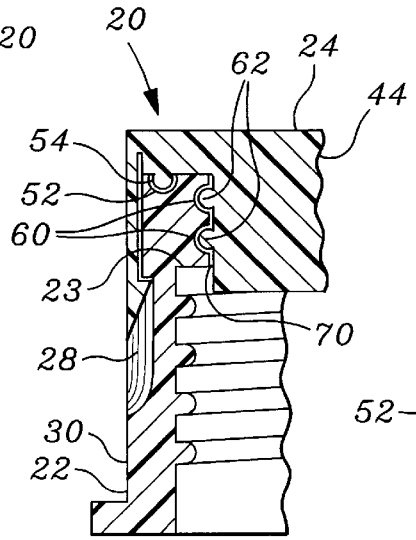
FIG. 4 is an enlarged cross sectional view, taken generally in the area of arrow 4 in FIG. 3.
Figure 4A:
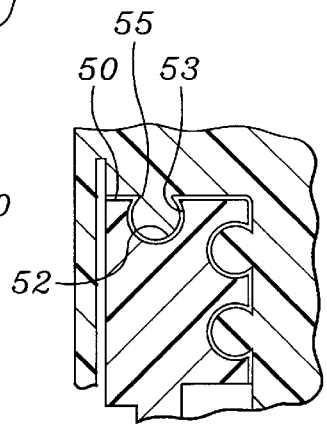
FIG. 4A is a further enlarged cross sectional view, taken generally in the area of arrow 4A in FIG. 4.

FIG. 4 is an enlarged cross sectional view, which further illustrates internal details of the cap assembly 20 as shown in FIG. 3. When the latch hook 29 engages the catch 36, the latch 28 is flush with the outer circumference 30 of the main portion 22. Referring momentarily to FIG. 4A, the main portion 22 has an upper surface 50 having an upper groove 52 which is concentric with the central bore 40. The lid 24 has an outer ring 54 that is concentric with the plug 44, larger in diameter than the plug 44 and which fits securely in the upper groove 52 to effect a tight seal between the lid 24 and main portion 22. The outer ring 54 and upper groove 52 comprise part of the sealing mechanism, whose purpose is to effect a tight seal between the lid 24 and main portion 22. FIG. 4A is a further enlarged cross sectional view which illustrates these details, and the nature of fit between the upper groove 52 and outer ring 54. The upper groove and outer ring do not have a semicircular cross section—their cross sectional shape is configured to allow a locking fit between them. Thus, the upper groove has a cross sectional characteristic such that it is narrower at its mouth 53 than within the groove itself, and the outer ring is wider opposite the lid than at its base 55, as illustrated in FIG. 4A.

The main portion 22 further has at least two concentric, internal grooves 60, vertically spaced along the central bore 40, extending outward within the central bore 40. The plug 44 has curved protuberances 62 which match the internal grooves 50 of the central bore 40 when the cap assembly 20 is in the closed position. The internal grooves 60 in conjunction with the curved protuberances provide further sealing of the lid 24 to the main portion 22.

A tight seal between the main portion 22 and the top 23 of the bottle 21 is effected by a lower sealing ring 70 which rests against the top 23. In general, all sealing components, including the lower sealing ring 70, and the curved protuberances 62, must be made of rubber, or the like, to effect tight seals where desired.

Figure 5:
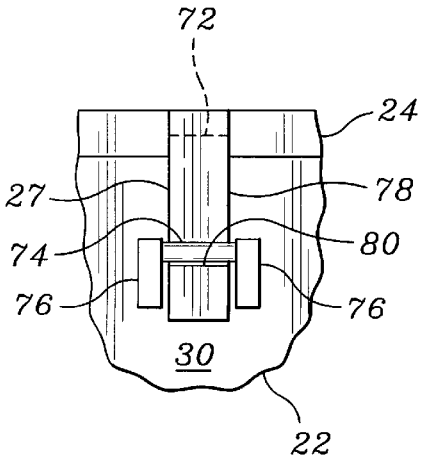
FIG. 5 is an enlarged side elevational view, taken generally in the area indicated by line 5,6 in FIG. 1.

FIG. 5 details the opening preventer 27. In a broad sense, the opening preventer 27 has a protection seal 72 which has sufficient strength to prevent inadvertent opening, but may be easily intentionally broken when desired. In the embodiment shown, the preventer 27 comprises a transverse bar 74 extending horizontally and tangentially to the outer circumference 30 of the main portion 22. The preventer 27 is spaced a small distance from the outer circumference 30 by a pair of end bars 76. The preventer 27 also includes a tab 78 which is attached to the lid 24, and extends between the transverse bar 72 and outer circumference 30. Vertical movement of the tab, and thus the lid 24 is prevented by a tab hook 80, which engages the transverse bar 72. The protection seal in the embodiment shown, is simply a horizontal scoring of the tab 78.

Figure 6:
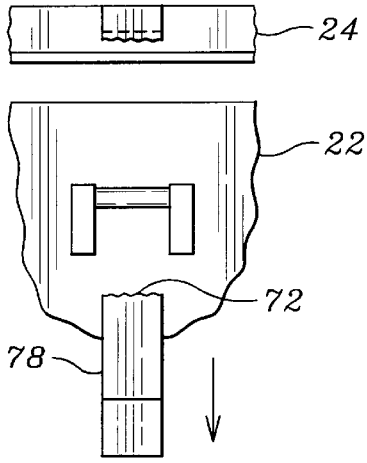
FIG. 6 is a side elevational view, taken in the same area as FIG. 5, except wherein the cap has been opened, breaking and freeing the opening preventer.

As illustrated in FIG. 6, to open the cap assembly 20, the protection seal 72 is broken, allowing the tab 78 to fall away, and allowing the lid 24 to move apart from the main portion 22.

Figure 7:
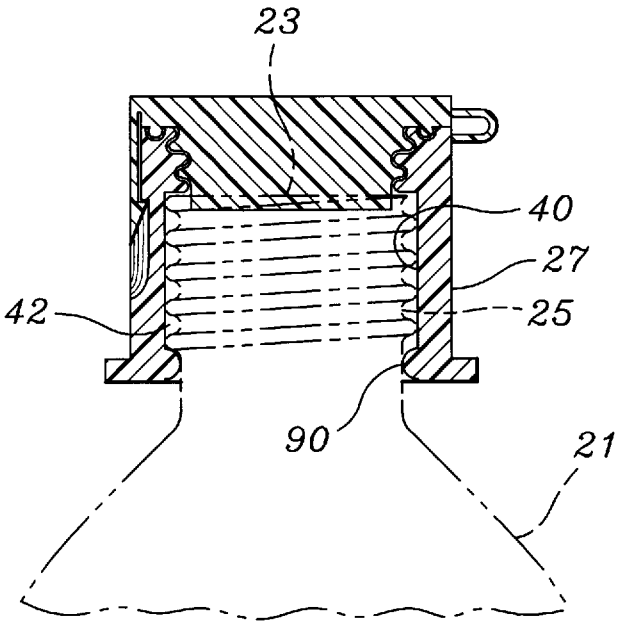
FIG. 7 is a cross sectional view, similar to FIG. 3, showing a second embodiment of the invention, having an alternate attachment scheme.

FIG. 7 illustrates a second embodiment of the invention, in which the main portion 22 has an inner flange 90 which prevents the cap assembly 20 from being removed from the bottle 21 once it has been attached thereupon. The bottle 21 has an externally threaded neck 25, near the top 23 of the bottle. The main portion is pressed onto the top 23 of the bottle, until the inner flange 90 flexes sufficiently to allow the central bore 40 to thread onto the threaded neck 25. Once the central bore 40 has been fully threaded onto the threaded neck 25, the inner flange 90 will reflex, catching immediately beneath the threaded neck 25 and preventing the main portion 22 from being removed from the bottle 21.

Figure 8:
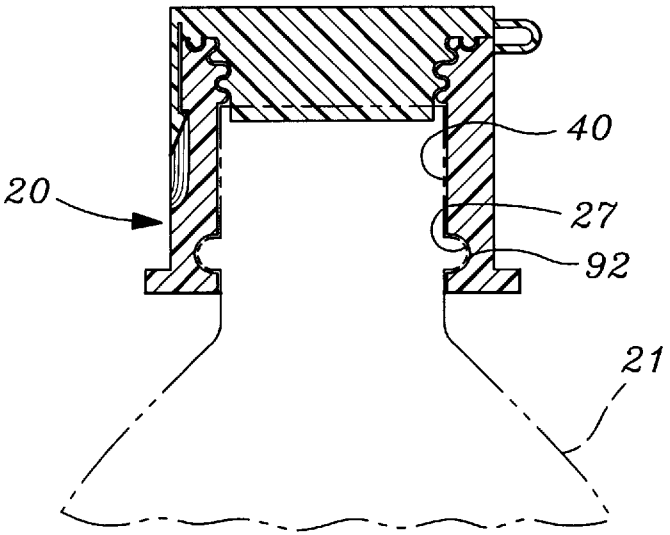
FIG. 8 is a cross sectional view, similar to FIG. 7, showing a third embodiment of the invention, having another attachment scheme.

FIG. 8 illustrates a third embodiment of the invention, in which the bottle 21 has an outward flange 27, and the central bore 40 has an attachment recess 92. The bottle 21 is urged up into the central bore 40, until the outward flange 72 deforms the central bore 40 sufficiently to enter the attachment recess 92, which then traps the outward flange 27 within, holding the cap assembly 20 onto the bottle 21.

Figure 9:
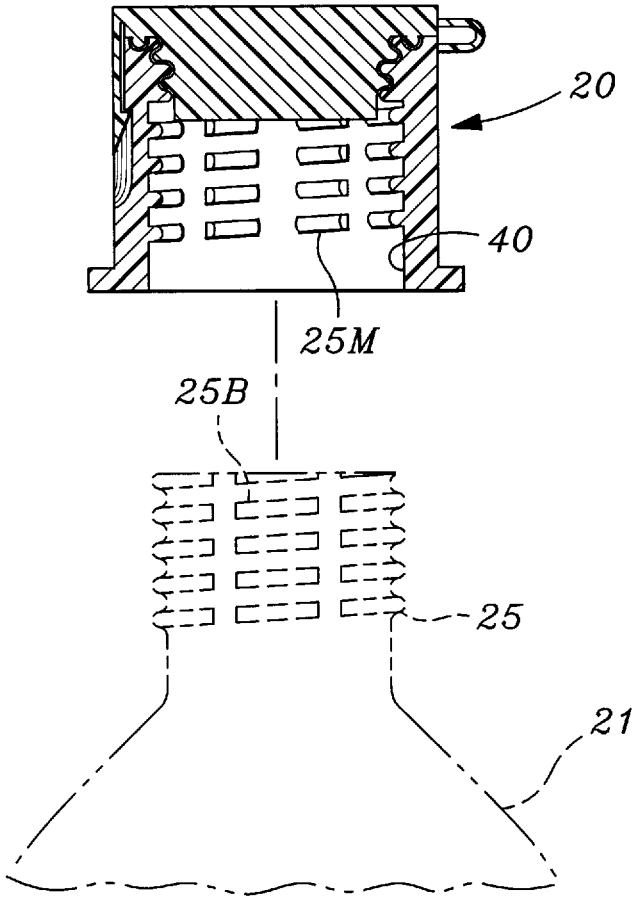
FIG. 9 is a cross sectional view, similar to FIG. 8, showing a fourth embodiment of the invention having a still further attachment scheme.

FIG. 9 illustrates a fourth embodiment of the invention, in which the threaded neck 25 comprises broken threads 25B, and wherein the central bore 40 has matching broken threads 25M. In a conventional manner, the broken thread 25B of the bottle 21 easily threads into the matching broken threads 25M of the central bore 40, but do not allow the same to be "unthreaded". Thus, once threaded onto the bottle 21, the cap assembly 20 cannot be removed therefrom.

In conclusion, herein is presented a bottle cap, which is particularly well suited to work with soda containers, such that said containers may be easily opened, and then closed, with a simple one handed operation. The necessity to screw and unscrew a cap on such a container is hereby eliminated by the instant invention.

What is claimed is:

1. A bottle cap, for attaching on a soda bottle having a bottle interior and providing selective access to said bottle interior, the bottle having a top, said top having an opening, comprising:

a main portion, said main portion having an attachment device for attaching over said top and forming a tight seal thereon, the main portion having a central bore in communication with the opening and the bottle interior, the main portion has an upper surface, said upper surface having an upper groove, said upper groove larger in diameter than the central bore and concentric therewith;

a lid, said lid attached to the main portion with a hinge, said lid having a plug which fits within the central bore, said lid has a ring, said ring equal in diameter to the upper groove, larger in diameter than the plug and concentric therewith;

a latch mechanism for securing the lid to the main portion at a point opposite the hinge;

a sealing mechanism between said lid and said main portion for providing a fluid and gaseous seal therebetween, the sealing has at least two circular grooves, concentric and vertically arranged along the central bore of the main portion, the plug has curved protuberances which match the grooves, the protuberances fit within the grooves to form a tight seal between the main portion and lid; and an opening preventer, having a protection seal, said preventer sealing the lid to the main portion until the protection seal is broken, the protection seal easily breakable with force exerted by a human hand upon the lid, but having sufficient strength to withstand internal pressure from the bottle interior, said protection seal further having:

a transverse bar, said bar extending horizontally and tangentially to the outer circumference, said bar spaced a small distance from the outer circumference;

a tab attached to the lid, the tab extending between the transverse bar and outer circumference, the tab having a tab hook located on the tab opposite the lid, the tab hook preventing the lid from motion relative to the main portion until the protection seal is broken.

2. The bottle cap as recited in claim 1, wherein said latch mechanism comprises a latch, said latch having a latch hook located on the latch opposite the lid, the latch mechanism further having a latch recess and a finger recess in the main portion, a catch is located between the latch recess and finger recess, when securing the lid to the main portion, the latch extends in the latch recess, and the latch hook holds fast at the catch.

3. The bottle cap as recited in claim 2, wherein the main portion has an outer circumference, and wherein the latch is flush with the outer circumference when the latch extends in the latch recess.

4. The bottle cap as recited in claim 3, wherein the attachment mechanism further comprises a threaded neck on the bottle, and wherein the central bore threads onto the threaded neck.

5. The bottle cap as recited in claim 4, wherein the threaded neck comprises broken threads, and the central bore has matching broken threads, the broken threads of the bottle thread onto the matching broken threads of the central bore but do not allow the matching broken threads to be subsequently un-threaded from the bottle.

6. The bottle cap as recited in claim 5, wherein the upper groove has a mouth and wherein the upper groove has a cross sectional characteristic such that it is narrower at the mouth than within the groove, and the outer ring is wider opposite the lid to provide a locking fit when the outer ring is inserted into the upper groove.

7. The bottle cap as recited in claim 1, wherein the upper groove has a mouth and wherein the upper groove has a cross sectional characteristic such that it is narrower at the mouth than within the groove, and the outer ring is wider opposite the lid to provide a locking fit when the outer ring is inserted into the upper groove.

* * * * *